US010551111B2

(12) United States Patent
Meng et al.

(10) Patent No.: US 10,551,111 B2
(45) Date of Patent: Feb. 4, 2020

(54) REFRIGERATOR

(71) Applicants: HEFEI MIDEA REFRIGERATOR CO., LTD., Hefei (CN); MIDEA GROUP CO., LTD., Foshan (CN)

(72) Inventors: Xianchun Meng, Hefei (CN); Zhongcheng Fang, Hefei (CN); Qunna Rui, Hefei (CN); Guofu Wu, Hefei (CN)

(73) Assignees: HEFEI MIDEA REFRIGERATOR CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/889,075

(22) Filed: Feb. 5, 2018

(65) Prior Publication Data

US 2018/0156532 A1 Jun. 7, 2018

Related U.S. Application Data

(63) Continuation of application No. PCT/CN2015/087407, filed on Aug. 18, 2015.

(30) Foreign Application Priority Data

Aug. 5, 2015 (CN) ..... 2015 1 0474712
Aug. 5, 2015 (CN) ..... 2015 2 0583502 U

(51) Int. Cl.
*F25B 5/04* (2006.01)
*F25D 11/02* (2006.01)
*F25D 23/06* (2006.01)

(52) U.S. Cl.
CPC ..... *F25D 23/061* (2013.01); *F25D 11/022* (2013.01); *F25D 23/066* (2013.01)

(58) Field of Classification Search
CPC .... F25D 23/061; F25D 11/022; F25D 23/066; F25D 25/028; F25B 5/04; F25B 2339/023; F25B 39/02
See application file for complete search history.

(56) References Cited

U.S. PATENT DOCUMENTS 2,576,208 A * 11/1951 Benson ..... F25D 23/061 62/444
3,766,979 A * 10/1973 Petrick ..... E21B 29/08 166/55

(Continued)

FOREIGN PATENT DOCUMENTS

CN 1862180 A 11/2006
CN 101566415 A 10/2009

(Continued)

OTHER PUBLICATIONS

Hefei Midea Refrigerator Co., Ltd., Midea Group Co., Ltd, Communication Pursuant to Article 94(3) EP15900123.9, dated Nov. 20, 2018, 4 pgs.

(Continued)

*Primary Examiner* — Melvin Jones
(74) *Attorney, Agent, or Firm* — Morgan, Lewis & Bockius LLP

(57) ABSTRACT

Disclosed is a refrigerator. First and second inner containers (110, 120) are respectively provided with first and second tube evaporators (210) in the inside thereof. The first and second inner containers (110, 120) are respectively provided with first and second winding tube evaporators (310, 320) on the outside thereof. First connecting tubes protrude from the first inner container (110) at two ends of the first tube evaporator (210), and the first winding tube evaporator (310) is connected to one of the first connecting tubes. Second connecting tubes protrude from the second inner container (120) at two ends of the second tube evaporator, the second (Continued)

winding tube evaporator (320) is connected to one of the second connecting tubes, and the other of the first connecting tubes is connected to the other of the second connecting tubes.

10 Claims, 3 Drawing Sheets

(56) References Cited

U.S. PATENT DOCUMENTS

| | | | | |
|---|---|---|---|---|
| 6,209,342 | B1 | 4/2001 | Banicevic et al. | |
| 2004/0226315 | A1* | 11/2004 | Gerstner | F25D 23/08 62/515 |
| 2011/0011120 | A1* | 1/2011 | Pocajt | F25B 39/02 62/440 |
| 2013/0139540 | A1* | 6/2013 | Eckartsberg | F25D 23/061 62/440 |

FOREIGN PATENT DOCUMENTS

| | | | |
|---|---|---|---|
| CN | 101990619 | A | 3/2011 |
| CN | 102997552 | A | 3/2013 |
| CN | 103115466 | A | 5/2013 |
| CN | 203148149 | U | 8/2013 |
| CN | 204154054 | U | 2/2015 |
| CN | 204963345 | U | 1/2016 |
| EP | 1541944 | A1 | 6/2005 |
| JP | S5538444 | A | 3/1980 |
| KR | 100630832 | B1 | 10/2006 |

OTHER PUBLICATIONS

Hefei Midea Refrigerator Co., Ltd., Midea Group Co., Ltd, First Office Action, dated Jan. 24, 2017, 13 pgs.

Midea, International Search Report and Written Opinion, PCT/CN2015087407, dated May 10, 2016, 19 pgs.

* cited by examiner

REFRIGERATOR

PRIORITY CLAIM AND RELATED APPLICATION

This application is a continuation application of PCT/CN2015/087407, entitled "REFRIGERATOR" filed on Aug. 18, 2015, which claims priority to Chinese Patent Application No. 201510474712.1, filed with the State Intellectual Property Office of the People's Republic of China on Aug. 5, 2015, and Chinese Patent Application No. 201520583502.1, filed with the State Intellectual Property Office of the People's Republic of China on Aug. 5, 2015, all of which are incorporated herein by reference in their entirety.

TECHNICAL FIELD

The present disclosure relates to a technical field of electric appliance manufacture, and specifically to a refrigerator.

BACKGROUND

In a refrigerator of the related art, an inlet and outlet of an evaporator thereof are welded in a refrigerator container, and the space is narrow and unbeneficial for a worker to operate, so that the assembling cost is increased. In addition, a welded region of the refrigerator container tends to be blackened due to high temperature and smoke generated by fire welding when the welding is performed in the refrigerator container, so that a rejection rate of the refrigerator container is increased. As the whole evaporator has a relatively long pipeline, temperature of the refrigerant in the pipeline varies along the pipe path, resulting in a relatively large temperature difference between a beginning end and a tail end of the evaporator, thereby increasing the temperature difference of the compartment of the refrigerator and seriously influencing energy efficiency of the whole machine.

SUMMARY

The present disclosure seeks to solve one of the technical problems existing in the related art to at least some extent. Thus, the present disclosure provides a refrigerator, which has advantages of even refrigeration, convenient assembly, a low rejection rate and etc.

In order to achieve the above-mentioned purpose, a refrigerator is provided according to embodiments of the present disclosure, the refrigerator includes: a refrigerator body; a first inner container and a second inner container, the first inner container and the second inner container being both disposed in the refrigerator body; a wire tube evaporator and a coiled tube evaporator, the wire tube evaporator including a first wire tube evaporator provided in the first inner container and a second wire tube evaporator provided in the second inner container, the coiled tube evaporator including a first coiled tube evaporator wound on an outside of the first inner container and a second coiled tube evaporator wound on an outside of the second inner container, two ends of the first wire tube evaporator being each provided with a first connecting tube, the two first connecting tubes both extending out of the first inner container, the first coiled tube evaporator being connected to a free end of one of the two first connecting tubes, two ends of the second wire tube evaporator being each provided with a second connecting tube, the two second connecting tubes both extending out of the second inner container, the second coiled tube evaporator being connected to a free end of one of the two second connecting tubes, and a free end of the other of the two first connecting tubes and a free end of the other of the two second connecting tubes being connected.

The refrigerator 1 according to embodiments of the present disclosure has advantages of even refrigeration, convenient assembly, a low rejection rate and etc.

In addition, the refrigerator according to embodiments of the present disclosure can further have the following additional technical features.

According to an embodiment of the present disclosure, the first inner container and the second inner container are arranged in parallel along left and right directions, the two first connecting tubes include a first left connecting tube and a first right connecting tube, the first left connecting tube and the first right connecting tube are spaced apart along the left and right directions, the two second connecting tubes include a second left connecting tube and a second right connecting tube, and the second left connecting tube and the second right connecting tube are spaced apart along the left and right directions.

According to an embodiment of the present disclosure, the first coiled tube evaporator is connected to the first left connecting tube, the second coiled tube evaporator is connected to the second right connecting tube, and the first right connecting tube is connected to the second left connecting tube.

According to an embodiment of the present disclosure, the first right connecting tube has a height same as the second left connecting tube, a free end of the first right connecting tube bends rightwards and a first bending region exhibits an arc-shaped transition, a free end of the second left connecting tube bends leftwards and a second bending region exhibits an arc-shaped transition.

According to an embodiment of the present disclosure, the first inner container is provided with two first tube through holes, the second inner container is provided with two second tube through holes, the two first connecting tubes extend out of the first inner container through the two first tube through holes respectively, and the two second connecting tubes extend out of the second inner container through the two second tube through holes respectively.

According to an embodiment of the present disclosure, a first flexible sleeve is fitted into the first tube through hole, the first connecting tube is fitted into the first flexible sleeve, a second flexible sleeve is fitted into the second tube through hole, and the second connecting tube is fitted into the second flexible sleeve.

According to an embodiment of the present disclosure, a first supporting boss is provided at an inside wall of the first inner container, the first wire tube evaporator is supported on the first supporting boss, a second supporting boss is provided at an inside wall of the second inner container, and the second wire tube evaporator is supported on the second supporting boss.

According to an embodiment of the present disclosure, a first fixing clip is provided in the first inner container, the first wire tube evaporator is mounted to the first fixing clip, a second fixing clip is provided in the second inner container, and the second wire tube evaporator is mounted to the second fixing clip.

According to an embodiment of the present disclosure, the first fixing clip is disposed at an inner top wall of the first inner container, the first wire tube evaporator is disposed to the first fixing clip and adjacent to the top wall of the first inner container, the second fixing clip is disposed at an inner top wall of the second inner container, and the second wire tube evaporator is disposed to the second fixing clip and adjacent to the top wall of the second inner container.

According to an embodiment of the present disclosure, the first coiled tube evaporator is clockwise wound on the outside of the first inner container in a direction from rear to front, and the second coiled tube evaporator is clockwise wound on the outside of the second inner container in the direction from rear to front.

Figure 1:
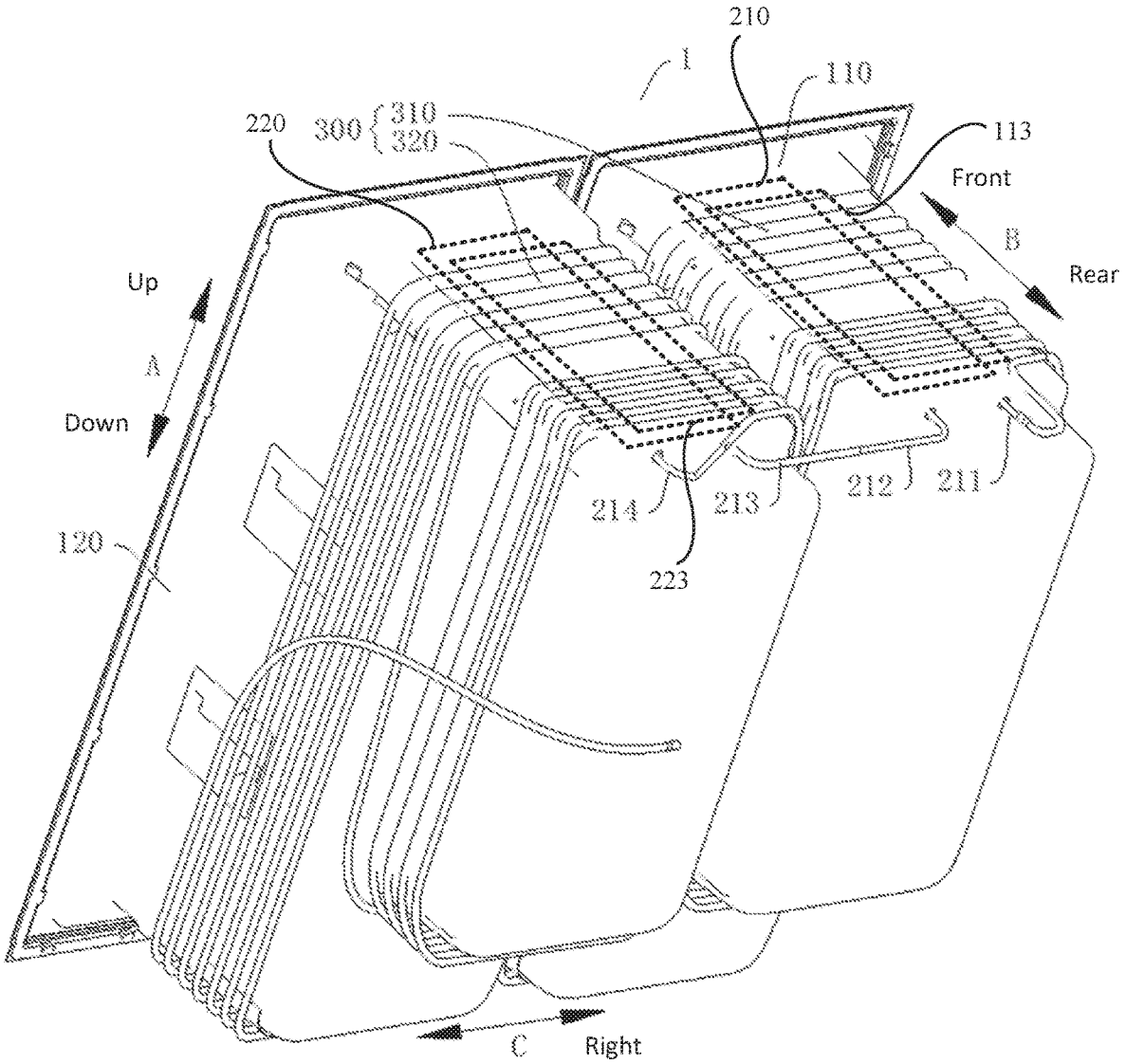
FIG. 1 is a partial schematic view of a refrigerator according to embodiments of the present disclosure.

Reference numerals: refrigerator 1, first inner container 110, first flexible sleeve 111, first supporting boss 112, first fixing clip 113, second inner container 120, first wire tube evaporator 210, first left connecting tube 211, first right connecting tube 212, second left connecting tube 213, second right connecting tube 214, coiled tube evaporator 300, first coiled tube evaporator 310, second coiled tube evaporator 320.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

A refrigerator 1 according to embodiments of the present disclosure is described with reference to the accompany drawings.

Figure 2:
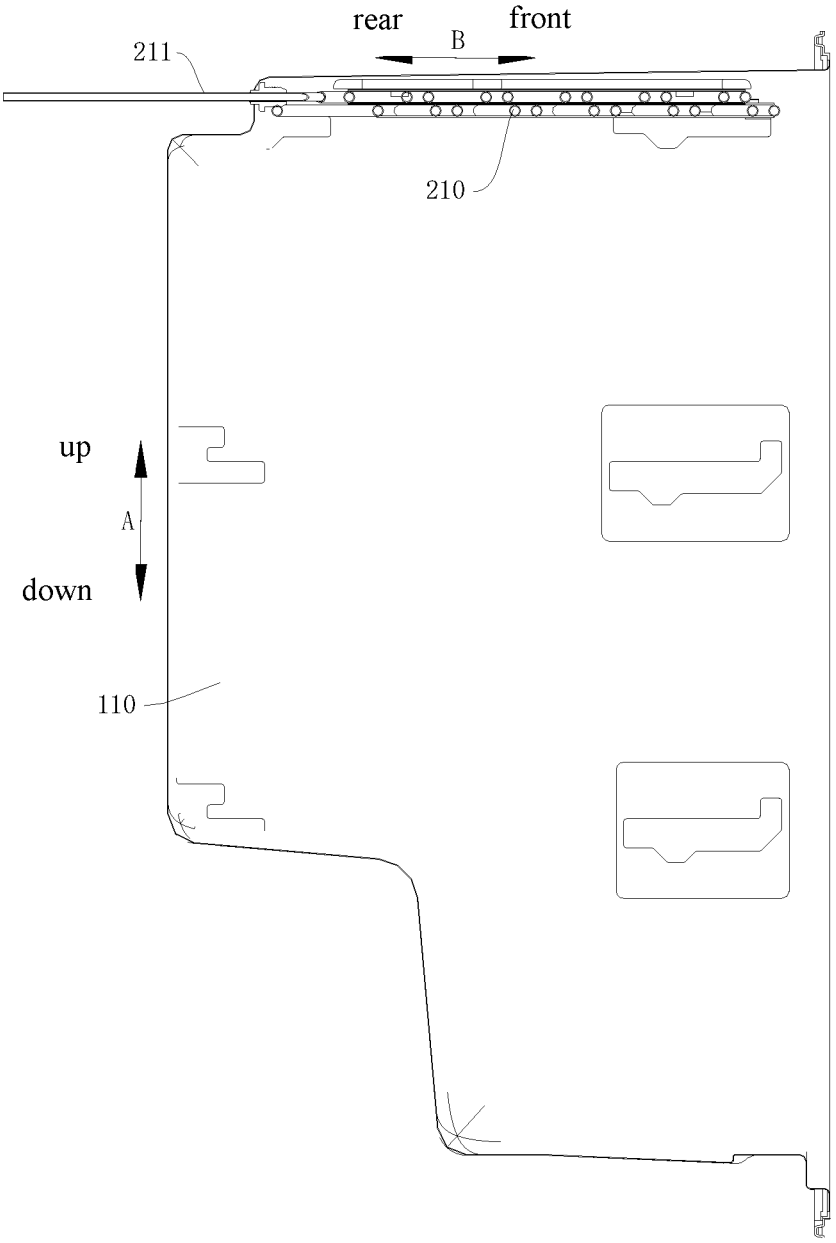
FIG. 2 is a partial sectional view of a refrigerator according to embodiments of the present disclosure.
Figure 3:
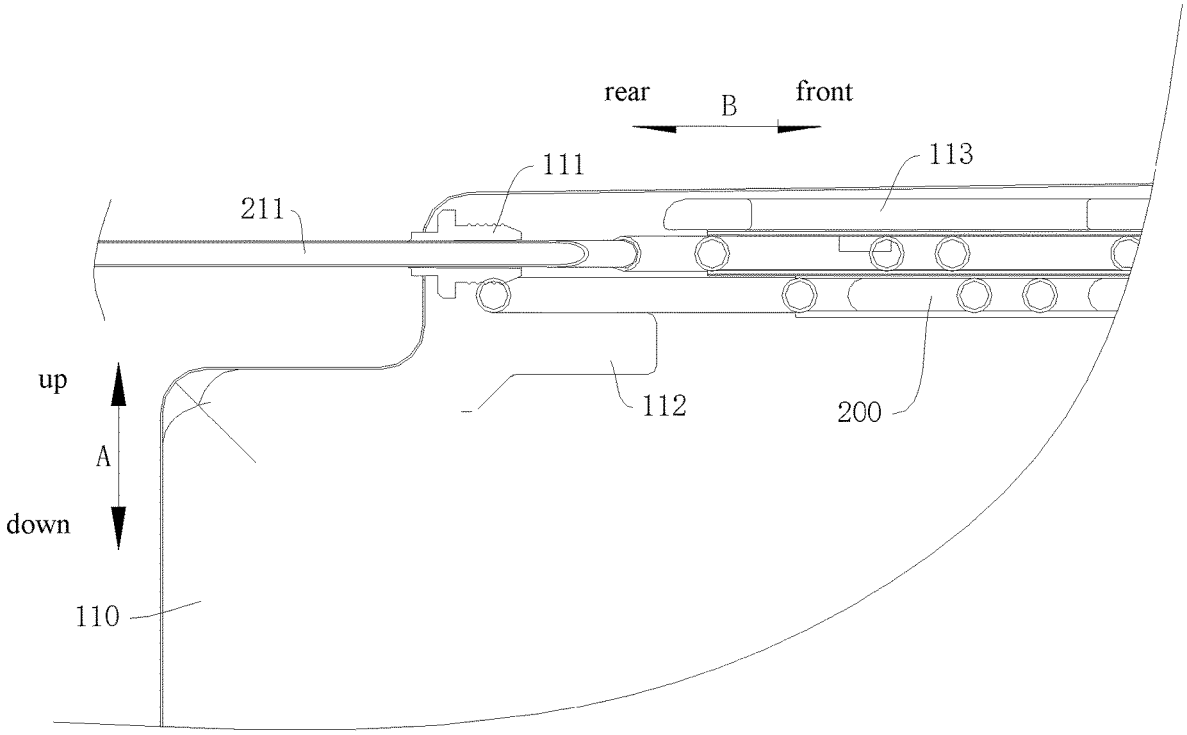
FIG. 3 is a partial sectional view of a refrigerator according to embodiments of the present disclosure.

As illustrated in FIG. 1 to FIG. 3, the refrigerator 1 according to embodiments of the present disclosure includes a refrigerator body (not illustrated in the drawings), a first inner container 110, a second inner container 120, a wire tube evaporator and a coiled tube evaporator 300.

The first inner container 110 and the second inner container 120 are both disposed in the refrigerator body. The wire tube evaporator includes a first wire tube evaporator 210 arranged in the first inner container 110 and a second wire tube evaporator 220 arranged in the second inner container 120. The coiled tube evaporator 300 includes a first coiled tube evaporator 310 wound on an outside of the first inner container 110 and a second coiled tube evaporator 320 wound on an outside of the second inner container 120, each of two ends of the first wire tube evaporator 210 are provided with a respective one of two first connecting tubes, the two first connecting tubes both extend out of the first inner container 110, the first coiled tube evaporator 310 is connected to a free end of a first one of the two first connecting tubes, each of two ends of the second wire tube evaporator 220 are provided with a respective one of two second connecting tubes, the two second connecting tubes both extend out of the second inner container 120, the second coiled tube evaporator 320 is connected to a free end of a first one of the two second connecting tubes, and a free end of a second one of the two first connecting tubes and a free end of a second one of the two second connecting tubes are connected.

In the refrigerator 1 according to embodiments of the present disclosure, by providing the first wire tube evaporator 210 and the first coiled tube evaporator 310, the first wire tube evaporator 210 and the first coiled tube evaporator 310 can be cooperatively used for the refrigeration of the first inner container 110; by providing the second wire tube evaporator and the second coiled tube evaporator, the second wire tube evaporator and the second coiled tube evaporator can be cooperatively used for the refrigeration of the second inner container 120. Thus, not only refrigeration effect on the first inner container 110 and the second inner container 120 can be improved, but also the first wire tube evaporator 210 can be arranged in an area at higher temperature inside the first inner container 110 and the second wire tube evaporator can be arranged in an area at higher temperature inside the second inner container 120, so that the temperatures in the first inner container 110 and the second inner container 120 are more even, a temperature difference in the refrigerator 1 is reduced, and an energy efficiency is increased. For example, as the cold air sinks, the first wire tube evaporator 210 can be arranged at an upper portion of the first inner container 110 and the second wire tube evaporator can be arranged at an upper portion of the second inner container 120, so that the refrigeration effect of the refrigerator 1 is more even.

In addition, by providing the first connecting tube which extends out of the first inner container 110 and the second connecting tube which extends out of the second inner container 120, it is possible to perform operations outside the first inner container 110 when connecting the first wire tube evaporator 210 and outside the second inner container 120 when connecting the second wire tube evaporator, which not only enlarges an operation space for an installer, facilities the connection for the first wire tube evaporator 210 and the second wire tube evaporator by the operator, thus increasing assembling efficiency of the first wire tube evaporator 210 and the second wire tube evaporator so as to improve production efficiency of the refrigerator 1, but also prevents the first inner container 110 and the second inner container 120 from being damaged when performing operations in the first inner container 110 and the second inner container 120, thus reducing a rejection rate of the first inner container 110 and the second inner container 120. For example, the first wire tube evaporator 210 and the first coiled tube evaporator 310 can be connected by welding, the second wire tube evaporator and the second coiled tube evaporator 320 can be connected by welding, and the first wire tube evaporator 210 and the second wire tube evaporator can be connected by welding, in this way, the welding can be performed outside the first inner container 110 and the second inner container 120 so as to enlarge the operation space and prevent the first inner container 110 and the second inner container 120 from being blackened.

Furthermore, the first coiled tube evaporator 310 is connected to the free end of one of the two first connecting tubes, the second coiled tube evaporator 320 is connected to the free end of one of the two second connecting tubes, and the free end of the other of the two first connecting tubes and the free end of the other of the two second connecting tube are connected, so that condensing agent can pass through one coiled tube evaporator, then pass through the two wire tube evaporators, and finally pass through one coiled tube evaporator, in other words, the condensing agent can pass through the first coiled tube evaporator 310, the first wire tube evaporator 210, the second wire tube evaporator and the second coiled tube evaporator 320 in sequence, or also can pass through the second coiled tube evaporator 320, the second wire tube evaporator, the first wire tube evaporator 210 and the first coiled tube evaporator 310 in sequence. As heat absorption and temperature rise occur to the condensing agent along with the increase of flow path when the condensing agent flows in the flowing route, with the above-mentioned arrangement, not only the temperature difference between the first inner container 110 and the second inner container 120 can be reduced, but also the temperature differences in the first inner container 110 and the second inner container 120 can be reduced, so that the refrigeration effect of the refrigerator 1 is more even.

Thus, the refrigerator 1 according to embodiments of the present disclosure 1 has advantages of even refrigeration, convenient assembly, a low rejection rate and etc.

The refrigerator 1 according to specific embodiments of the present disclosure is described with reference to the accompany drawings.

The first inner container 110 and the second inner container 120 are arranged in parallel along left and right directions, the two first connecting tubes include a first left connecting tube 211 and a first right connecting tube 212, the first left connecting tube 211 and the first right connecting tube 212 are spaced apart along the left and right directions, the two second connecting tubes include a second left connecting tube 213 and a second right connecting tube 214, and the second left connecting tube 213 and the second right connecting tube 214 are spaced apart along the left and right directions. Thus, the first left connecting tube 211, the first right connecting tube 212, the second left connecting tube 213 and the second right connecting tube 214 can be formed conveniently.

Advantageously, as illustrated in FIG. 1, the first coiled tube evaporator 310 can be connected with the first left connecting tube 211, the second coiled tube evaporator 320 can be connected with the second right connecting tube 214, and the first right connecting tube 212 can be connected with the second left connecting tube 213. Thus, it is convenient for the connection of the first coiled tube evaporator 310 with the first left connecting tube 211, the connection of the second coiled tube evaporator 320 with the second right connecting tube 214, and the connection of the first right connecting tube 212 with the second left connecting tube 213, moreover it is convenient for controlling a length of a pipeline, which can reduce the material cost on one hand, and reduce the refrigeration capacity loss of the condensing agent on the other hand, thus increasing the refrigeration efficiency of the refrigerator 1.

More advantageously, as illustrated in FIG. 1, the first right connecting tube 212 has a height same as the second left connecting tube 213, a free end of the first right connecting tube 212 bends rightwards and a first bending region exhibits an arc-shaped transition, a free end of the second left connecting tube 213 bends leftwards and a second bending region exhibits an arc-shaped transition. Thus, the connection of the first right connecting tube 212 with the second left connecting tube 213 can be further facilitated, and resistance occurring when the condensing agent flows through the first right connecting tube 212 and the second left connecting tube 213 can be reduced.

FIGS. 1 to 3 illustrate the refrigerator 1 in a specific example of the present disclosure. As illustrated in FIG. 1 to FIG. 3, the first inner container 110 is provided with two first tube through holes, the second inner container 120 is provided with two second tube through holes, the two first connecting tubes extend out of the first inner container 110 through the two first tube through holes respectively, and the two second connecting tubes extend out of the second inner container 120 through the two second tube through holes respectively. Thus, it not only facilitates the extension of the two first connecting tubes out of the first inner container 110 and the extension of the second connecting tube out of the second inner container 120, but also prevents the first connecting tubes from occupying the space in front of the first inner container 110 and prevents the second connecting tubes from occupying the space in front of the second inner container 120, so that the space utilization ratio can be increased. In addition, it is further possible to prevent the structures of the first connecting tubes and the second connecting tubes from being exposed and influencing aesthetics.

Advantageously, as illustrated in FIG. 2 and FIG. 3, a first flexible sleeve 111 is fitted into the first tube through hole, the first connecting tube is fitted into the first flexible sleeve 111, a second flexible sleeve is fitted into the second tube through hole, and the second connecting tube is fitted into the second flexible sleeve. Specifically, both the first flexible sleeve 111 and the second flexible sleeve can be rubber sleeves. Thus, the first flexible sleeve 111 and the second flexible sleeve can be used for cushioning the first connecting tube and the second connecting tube, which not only prevents the first connecting tube and the second connecting tube from being damaged due to collision, but also prevents the first connecting tube and the second connecting tube from making noise due to collision.

Specifically, as illustrated in FIG. 2 to FIG. 3, a first supporting boss 112 is provided at an inside wall of the first inner container 110, the first wire tube evaporator 210 is supported on the first supporting boss 112, a second supporting boss is provided at an inside wall of the second inner container 120, and the second wire tube evaporator is supported on the second supporting boss. Thus, the first supporting boss 112 and the second supporting boss can be used to support the first wire tube evaporator 210 and the second wire tube evaporator respectively, thereby facilitating the installation of the first wire tube evaporator 210 and the second wire tube evaporator.

More specifically, as illustrated in FIG. 2 and FIG. 3, a first fixing clip 113 is provided in the first inner container 110, the first wire tube evaporator 210 is mounted to the first fixing clip 113, a second fixing clip 223 is provided in the second inner container 120, and the second wire tube evaporator 220 is mounted to the second fixing clip 223. Thus, the first fixing clip 113 and the second fixing clip 223 can be used to fix the first wire tube evaporator 210 and the second wire tube evaporator 220 respectively, thereby conveniently arranging the first wire tube evaporator 210 and the second wire tube evaporator 220 in the first inner container 110 and the second inner container 120 respectively.

As illustrated in FIG. 2 and FIG. 3, the first fixing clip 113 is disposed at an inner top wall of the first inner container 110, the first wire tube evaporator is disposed to the first fixing clip 113 and adjacent to the top wall of the first inner container 110, the second fixing clip 223 is disposed at an inner top wall of the second inner container 120, and the second wire tube evaporator 220 is disposed to the second fixing clip 223 and adjacent to the top wall of the second inner container 120. Thus, it is convenient for arranging the first wire tube evaporator 210 and the second wire tube evaporator 220 at the upper portions of the first inner container 110 and the second inner container 120 respectively so as to balance the refrigeration effect of the refrigerator 1.

In some embodiments, as illustrated in FIG. 1, the first coiled tube evaporator 310 is clockwise wound on the outside of the first inner container 110 in a direction from rear to front, and the second coiled tube evaporator 320 is clockwise wound on the outside of the second inner container 120 in the direction from rear to front. Thus, it not only facilities the connection of the first coiled tube evaporator 310 with the first wire tube evaporator 210 and the connection of the second coiled tube evaporator 320 with the second wire tube evaporator, but also further improves the evenness of the refrigeration effect of the refrigerator 1.

Certainly, the second coiled tube evaporator 320 and the first coiled tube evaporator 310 can also be wound in other ways according to practical requirements.

The accompany drawings just illustrate the structure in the first inner container 110 and the structure in the second inner container 120 can make reference to the structure in the first inner container 110.

Other configurations and operations of the refrigerator 1 according to embodiments of the present disclosure are known to those ordinarily skilled in the related art, which will not be described in detail herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "axial," "radial," "circumferential direction," "clockwise," and "counterclockwise" should be construed to refer to the orientation as then described or as shown in the drawings under discussion. These relative terms are for convenience of description and do not require that the present disclosure be constructed or operated in a particular orientation, thus cannot be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical connection, electrical connections, or be communicable to each other; may also be direct connections or indirect connections via intervening structures; may also be inner communications or interaction relationship of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples. Those skilled in the art can integrate and combine different embodiments or examples and the features in different embodiments or examples in the specification without conflicting with each other.

Although embodiments of the present disclosure have been shown and illustrated, it shall be understood that the above-mentioned embodiments are illustrative and cannot be construed to limit the present disclosure. Those skilled in the art can make various changes, modifications, alternatives and variants in the scope of the present disclosure.

What is claimed is:

1. A refrigerator, comprising:

a refrigerator body;

a first inner container and a second inner container, the first inner container and the second inner container being both disposed in the refrigerator body;

a wire tube evaporator and a coiled tube evaporator, the wire tube evaporator comprising a first wire tube evaporator provided in the first inner container and a second wire tube evaporator provided in the second inner container, the coiled tube evaporator comprising a first coiled tube evaporator wound on an outside of the first inner container and a second coiled tube evaporator wound on an outside of the second inner container, each of two ends of the first wire tube evaporator being provided with a respective one of two first connecting tubes, the two first connecting tubes both extending out of the first inner container, the first coiled tube evaporator being connected to a free end of a first one of the two first connecting tubes, each of two ends of the second wire tube evaporator being provided with a respective one of two second connecting tubes, the two second connecting tubes both extending out of the second inner container, the second coiled tube evaporator being connected to a free end of a first one of the two second connecting tubes, and a free end of a second one of the two first connecting tubes and a free end of a second one of the two second connecting tubes being connected.

2. The refrigerator according to claim 1, wherein the first inner container and the second inner container are arranged in parallel along left and right directions, the two first connecting tubes comprise a first left connecting tube and a first right connecting tube, the first left connecting tube and the first right connecting tube are spaced apart along the left and right directions, the two second connecting tubes comprise a second left connecting tube and a second right connecting tube, and the second left connecting tube and the second right connecting tube are spaced apart along the left and right directions.

3. The refrigerator according to claim 2, wherein the first coiled tube evaporator is connected to the first left connecting tube, the second coiled tube evaporator is connected to the second right connecting tube, and the first right connecting tube is connected to the second left connecting tube.

4. The refrigerator according to claim 3, wherein the first right connecting tube has a height same as the second left connecting tube, a free end of the first right connecting tube bends rightwards and a first bending region exhibits an arc-shaped transition, a free end of the second left connecting tube bends leftwards and a second bending region exhibits an arc-shaped transition.

5. The refrigerator according to claim 1, wherein the first inner container is provided with two first tube through holes, the second inner container is provided with two second tube through holes, the two first connecting tubes extend out of the first inner container through the two first tube through holes respectively, and the two second connecting tubes extend out of the second inner container through the two second tube through holes respectively.

6. The refrigerator according to claim 5, wherein a first flexible sleeve is fitted into the first tube through hole, the first connecting tube is fitted into the first flexible sleeve, a second flexible sleeve is fitted into the second tube through hole, and the second connecting tube is fitted into the second flexible sleeve.

7. The refrigerator according to claim 1, wherein a first supporting boss is provided at an inside wall of the first inner container, the first wire tube evaporator is supported on the first supporting boss, a second supporting boss is provided at an inside wall of the second inner container, and the second wire tube evaporator is supported on the second supporting boss.

8. The refrigerator according to claim 1, wherein a first fixing clip is provided in the first inner container, the first wire tube evaporator is mounted to the first fixing clip, a second fixing clip is provided in the second inner container, and the second wire tube evaporator is mounted to the second fixing clip.

9. The refrigerator according to claim 8, wherein the first fixing clip is disposed at an inner top wall of the first inner container, the first wire tube evaporator is disposed to the first fixing clip and adjacent to the top wall of the first inner container, the second fixing clip is disposed at an inner top wall of the second inner container, and the second wire tube evaporator is disposed to the second fixing clip and adjacent to the top wall of the second inner container.

10. The refrigerator according to claim 1, wherein the first coiled tube evaporator is clockwise wound on the outside of the first inner container in a direction from rear to front, and the second coiled tube evaporator is clockwise wound on the outside of the second inner container in the direction from rear to front.

* * * * *